US009163912B1

(12) United States Patent
Stark

(10) Patent No.: US 9,163,912 B1
(45) Date of Patent: Oct. 20, 2015

(54) REACTIVE TARGETS

(71) Applicant: David W. Stark, Nampa, ID (US)

(72) Inventor: David W. Stark, Nampa, ID (US)

( * ) Notice: Subject to any disclaimer, the term of this patent is extended or adjusted under 35 U.S.C. 154(b) by 0 days.

(21) Appl. No.: 14/074,526

(22) Filed: Nov. 7, 2013

(51) Int. Cl.
*F41J 7/04* (2006.01)
*F41J 1/10* (2006.01)

(52) U.S. Cl.
CPC ..... *F41J 7/04* (2013.01); *F41J 1/10* (2013.01)

(58) Field of Classification Search
CPC ..... A63F 9/0204; F41J 7/04
USPC ..... 273/390, 393, 407, 386, 391, 392, 406, 273/348, 397, 380, 398, 399, 400, 410, 273/401; 473/16; 446/266, 411
See application file for complete search history.

(56) References Cited

U.S. PATENT DOCUMENTS

| | | | | |
|---|---|---|---|---|
| 2,133,552 | A | 10/1938 | Long | |
| 3,008,714 | A * | 11/1961 | Pullen | 273/393 |
| 5,967,523 | A * | 10/1999 | Brownlee | 273/407 |
| 6,994,348 | B2 | 2/2006 | Lambert et al. | |
| 6,994,349 | B2 | 2/2006 | Lambert et al. | |
| 7,422,216 | B1 | 9/2008 | Underhill | |
| 7,690,656 | B2 | 4/2010 | Saunders | |
| 7,735,832 | B2 * | 6/2010 | Bliehall | 273/393 |
| 2004/0239035 | A1 * | 12/2004 | Lambert et al. | 273/348 |
| 2006/0125185 | A1 * | 6/2006 | Rolfe | 273/390 |
| 2008/0265511 | A1 | 10/2008 | Shum | |
| 2013/0207347 | A1 | 8/2013 | Sovine | |

FOREIGN PATENT DOCUMENTS

WO WO2012174859 12/2012

OTHER PUBLICATIONS

Challenge Targets—Steel Target Stand with 7" AR500 Metal Plate, Oct. 9, 2013, p. 2.*
http://www.thetargetman.com/product-category/ar500-shooting-targets/.

* cited by examiner

*Primary Examiner* — Gene Kim
*Assistant Examiner* — Rayshun K Peng
(74) *Attorney, Agent, or Firm* — Dwayne E. Rogge; Schacht Law Office, Inc.

(57) ABSTRACT

Disclosed herein is a reactive target for shooting sports and competitions. The reactive target having a plurality of target paddles relative to a pivoting target arm to provide a dueling competition configuration and an arcade configuration. The target paddles being substantially identical and interchangeable.

10 Claims, 5 Drawing Sheets

REACTIVE TARGETS

BACKGROUND OF THE DISCLOSURE

Field of the Disclosure

This disclosure relates to the field of target devices which comprises or includes a point of aim for an aerial projectile and which is intended to be used to indicate the correctness of aim for an aerial projectile thrown, projected, impelled, or launched thereat.

The disclosure relates to the sub-field of target devices (a) wherein the target device or the point of aim portion thereof moves whenever a projectile impinges of impacts thereupon, and wherein the movement of the target device or the point of aim provides or produces a visible indication that a projectile has reached the point of aim, or (b) wherein the target device includes an indicating member which is moved whenever a projectile reaches the point of aim, and wherein the movement of the indicating member provides or produces a visible indication that a projectile has reached the point of aim. Wherein the target device or the point of aim portion thereof is moved about a fixed axis whenever a projectile impinges or impacts thereupon, and wherein the movement of the target device or the point of aim about the fixed axis provides or produces a visible indication that a projectile has reached the point of aim. Wherein the movement of the target device or the point of aim about a fixed axis is from an aiming position to an indicating position whenever a projectile impinges or impacts upon the point of aim, and wherein the target device includes means to reset or restore the target device or the point of aim from the moved position back to the aiming position. The method to reset or restore the target device or the point of aim from one position back to the aiming position may be actuated and operated without any intervention of a human operator

BRIEF SUMMARY OF THE DISCLOSURE

Disclosed herein is a reactive target comprising: a ground-engaging base; a support leg extending vertically from the base; and a projectile resistant target arm having a plurality of target paddles movably attached to a transverse rear side thereof. The target arm in one example operates in a dueling configuration wherein a long axis of the target arm is oriented vertically and wherein the target paddles pivot about a target paddle axis perpendicular to the long axis of the target arm. The target arm is also operable in an arcade configuration wherein the target paddles pivot about an axis parallel to the long axis of the target arm. The target arm has a transversely aligned target arm pivot generally at the vertical center thereof to allow repositioning of the target arm from the dueling configuration to the arcade configuration; and wherein the target arm pivot is coupled to an upper region of the support leg.

The reactive target may be arranged wherein the target arm in the dueling configuration is at an angle of less than 90° to the base with an upper end of the target arm positioned forward of the lower end so as to bias the target paddles to a forward facing position. In a narrower range, the target arm in the dueling configuration is at an angle of between 90° and 70° to the base with an upper end of the target arm positioned forward of a lower end. In an even narrower range, the target arm in the dueling configuration is at an angle of between 85° and 75° to the base with an upper end forward of the lower end.

The reactive target as recited above may be arranged wherein the target arm is pivotably and adjustably coupled to the base to allow variation of the relative angle between the two components.

The reactive target as recited above may be arranged wherein the paddles are removably attached to the target arm by way of a coil spring attached to the target arm and an indent/detent of the target arm. In addition, the apparatus may be arranged wherein impact from a projectile removes the impacted target paddle from the target arm; and wherein removal of the impacted target paddle effects rotation of the target arm about the target arm pivot.

The reactive target as recited above may further comprise a pivot stop arm having a first end attached to the base and a second end coupled to the target arm so as to prevent rotation of the target arm in the dueling target configuration.

The reactive target as recited above may be arranged wherein the pivot stop arm is pivotably coupled to the base.

The reactive target as recited above may be arranged wherein all target paddles are substantially identical and interchangeable. This allows the targets to be removed and replaced easily and cheaply.

The reactive target as recited above may be arranged wherein all target paddles consist of a flat panel unitary and homogenous body. Unitary meaning no additional components attached or fastened to the flat panel. Homogenous meaning produced as a single component such as steel with the entire component having the same material, hardness, rather than a plurality of materials fastened or otherwise affixed.

DETAILED DESCRIPTION OF THE DISCLOSURE

Figure 1:
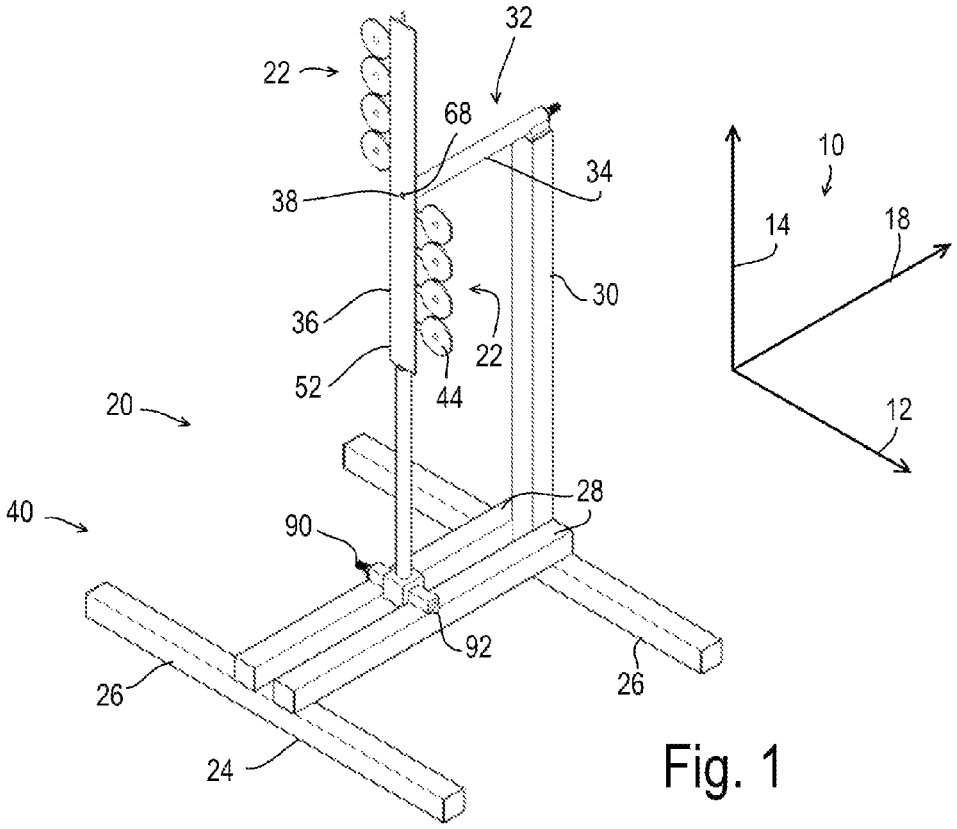
FIG. 1 is a front isometric view of one example of the reactive target in a dueling target configuration.

In the shooting sports; automatically resetting targets are commonly employed so that shooters may participate in games and competitions, improve accuracy, practice shooting skills etc. without the need for destroying targets such as the paper targets commonly used on firearm shooting ranges. While examples similar to these commonly found in the firearm shootings sports known to rifles, shotguns, and pistols; the disclosure herein is also relevant to other shooting and projectile sports such as bow and arrow, crossbow, throwing skills, slingshot and other sports and games wherein projectiles are released to contact a target.

While dueling target are well-known in shooting sports arts, such as the dueling tree disclosed in U.S. Pat. No. 6,994,348, and while arcade-style targets such as the target disclosed in U.S. Pat. No. 7,422,216 are well-known in the art, a combination dueling tree and arcade target with the modifications and improvements disclosed herein is novel in light of the known prior art. In addition, examples shown herein disclose interchangeable target paddles which can be moved from a first holder when used in the dueling target configuration to a second holder when used in the arcade configuration. By rotating the target arm about a horizontally aligned target arm pivot; the apparatus can be reconfigured very quickly and easily from the dueling configuration to the arcade configuration. In one example reconfiguring the apparatus also requires repositioning the target paddles from a first set of holders to a second set of holders.

Shown in the drawings and disclosed herein is a reactive target 20 wherein the term "reactive" indicates that the apparatus (target) reacts to a stimulus. In this disclosure stimulus being contact with a projectile on the forward face of each of the target paddles 22.

The reactive target 20 in this example comprising a base 24 which rests upon a ground surface such as dirt, Earth, grass, the floor of a building etc. to provide a stable platform for the components positioned vertically there above. In another example, the support leg may be driven, set, or otherwise fixed in place without the base 24. In the example shown in the drawings, the base 24 comprises a plurality of lateral extensions 26 interconnected by way of a plurality of transverse extensions 28. These extensions may be metal extrusion, wood, plastic or other materials which are welded, bolted, riveted, screwed, glued, or otherwise fastened together. Shown extending vertically from the base 24 is a support leg 30. The support leg 30 having a pivot apparatus 32 attached thereto which extends transversely forward therefrom. In the example shown, the pivot apparatus 32 comprises a transverse pivot support 34 extending transversely from the support leg 30 to the target arm 36. The target arm 36 having a target arm pivot 38 generally at the vertical center portion thereof when the target arm is in the dueling configuration 40 and generally at the horizontal center portion when the target arm is in the arcade configuration 42.

Figure 7:
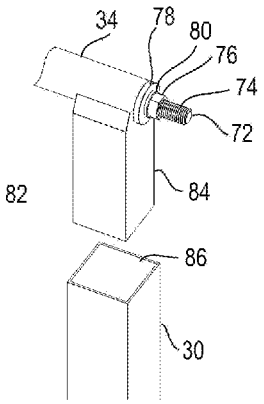
FIG. 7 is a detail enlarged view of a portion of the example shown in FIG. 6.

The target arm pivot 38 in this example comprises a surface defining a substantially circular void 68 (hole) (FIG. 1) there through. In this example, a bolt head 70 (FIG. 2) can be seen on the forward transverse face of the target arm 36 and it is understood that the bolt 72 (FIG. 7) may extend through the target arm 36, through the transverse pivot support 34, and may comprise a male threaded portion 74 projecting rearward therefrom. The threaded portion 74 has a female threaded nut 76 attached there though, with an optional washer 78 positioned on the bolt 72 between the nut 76 and the pivot support 34. A lock washer 80 or compression spring may be used to keep the nut 76 from unthreading itself and to provide additional frictional force to keep the target arm 34 from rotating when rotation is not desired.

Before continuing a detailed description, an axes system 10 is shown in FIG. 1 comprising a vertical axis 14 pointing in an upwards direction, as well as a lateral axis 12 with the pointing in a right direction with the opposing direction being a left direction. The vertical axis 14 and the lateral axis 12 generally define a vertical/lateral plane through which the target arm 36 pivots from a dueling configuration 40 to the arcade configuration 42. The axes system 10 also comprises a transverse axis 14 with the arrow pointing in a rearward direction. The lateral axis 12 and the transverse axis 16 defining a horizontal plane about which the target paddles 22 rotate when the reactive target 20 is in the dueling configuration 40. The vertical 14 and transverse 16 axes defining a vertical/transverse axis through which the target paddles 22 pivot when the reactive target 20 is in the arcade configuration 42. These axes and planes intended to aid in description of the apparatus and methods of operation and are not intended to be read as limiting the apparatus to a specific orientation in use. The limitations of this disclosure are to be determined by the claims below.

Looking to FIG. 1, the reactive target 20 in the dueling configuration 40 can be seen wherein the target arm 36 has a plurality of target paddles 22 attached to the rear surface thereof. The target paddles 22 in this dueling configuration 40 projecting laterally to the right and left from the target arm 36. In a dueling style game or competition the target paddles 22 will generally begin having a specified (normally the same) number of paddles in each of the right and left lateral sides. For example, in FIG. 1 the four uppermost target paddles 22 are projecting from the left lateral side of the target arm 36 whereas the four lowermost target paddles 22 are projecting from the right lateral side of the target arm 36. In one form of a dueling competition, shooters will stand laterally side-by-side and begin shooting simultaneously. In some competitions there will be a time limit for the shooters, and in other competitions there may be a specified number of projectiles available to each shooter.

Figure 5:
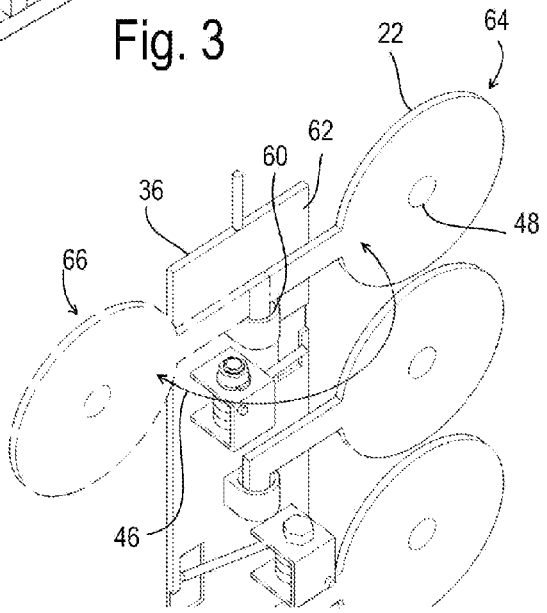
FIG. 5 is a detail enlarged view of the example shown in FIG. 4 with one target paddle rotating about a pivot bracket.

By way of example the shooter to the right may fire upon the target paddles 22 on the right side and upon contacting the face 44 of the target paddle, impact of the projectile thereupon will pivot the target paddle in the horizontal rotation arc 46 shown in FIG. 5 to the opposing (left) side. Similarly, the shooter to the left will fire upon the target paddles 22 on the left side with the intent to get all of the paddles on the left side pivoted to the right side. Firing will commence and continue until either: the time limit is expended, projectiles are expended, or another competition ending event has occurred. Once the competition has ended; the shooter with the fewest number of target paddles on their side of the target arm 36 will generally be declared the winner.

Similarly, in a practice situation a shooter may simply aim for the paddles 22 or alternatively a marking such as a center bull 48 on each target paddle 22. As contact is made, the target paddle 22 will rotate to the opposing side and provide a new target for the shooter. Who may then continue shooting without interruption of re-setting targets.

Figure 4:
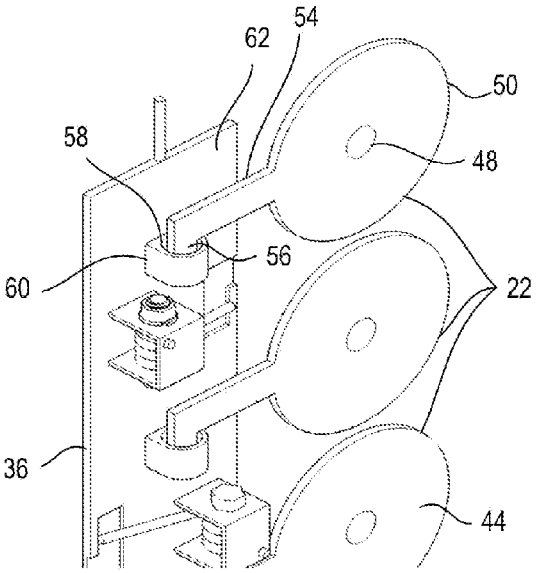
FIG. 4 is a detail enlarged view of the upper region of the example shown in FIG. 3.

Looking to FIG. 4, it can be seen how each of the paddles 22 generally comprise a circular target 50. The target 50 need not be circular and may be square, rectangular, oval, or other shape and may have an open region therein. It will generally be desired for the target paddles 22 and all other forward facing components of the apparatus to be made of a projectile resistant material. For example, when the apparatus is designed for use with high-caliber rifles or other firearms, heavy gauge metals such as steel or aluminum may be utilized such that any impact of a high velocity projectile (bullet) will not significantly and or terminally damage the apparatus.

As the paddles 22 has slightly less mass and are not rigidly fixed in place, they are slightly less susceptible to damage as pivoting of the target paddles 22 about the rotational arc 46 will absorb some of the impact from the projectile contact.

Figure 12:
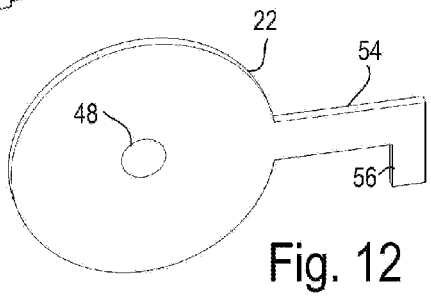
FIG. 12 is a view of one example of a target paddle used in the apparatus disclosed herein.

It may be desired that the transverse front 52 of the non-target portion of the apparatus be painted or coated to reduce visibility and to improve weather ability. In the example shown, each of the paddles 22 (FIG. 12) also comprise an extension arm 54 extending toward the target arm 36 having an L-shape with a protrusion 56 generally at right angles to the extension arm 54. In the dueling configuration 40, the protrusion 56 extends vertically downward into a surface defining a vertically aligned opening 58 in a pivot bracket 60 attached to the transverse rear surface 62 of the target arm 36. As the forward facing target surface of the paddle 22 is impacted such as by a projectile, it will rotate through the arc 46 from a left position 64 to a right position 66 and vice-versa.

Figure 13:
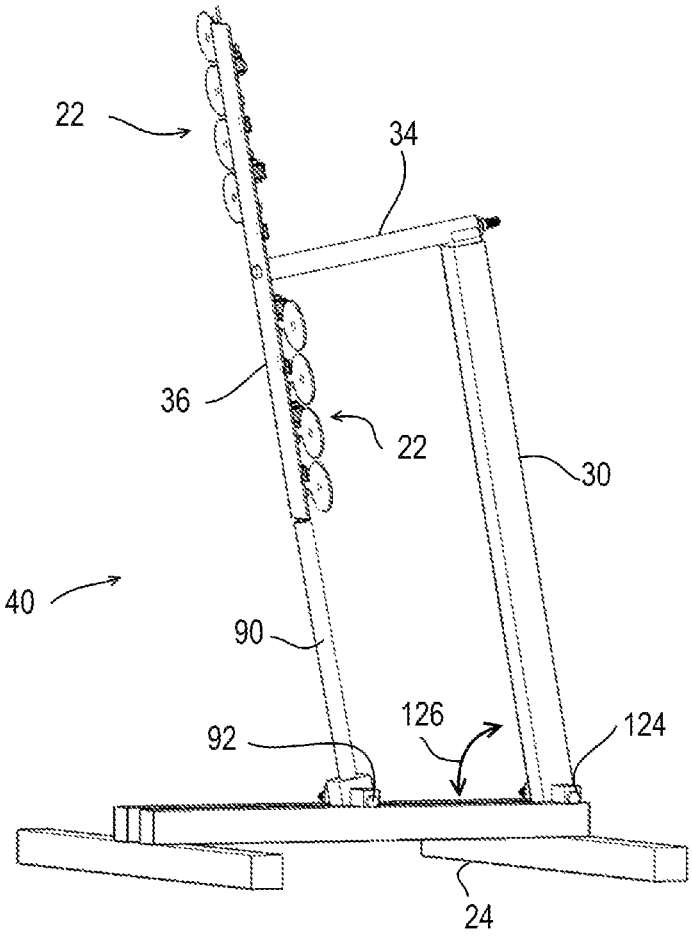
FIG. 13 is a front isometric view of one example of the reactive target in a dueling target configuration pivoted forward to bias the target paddles to a forward facing position.

Several variations are conceived for biasing the paddles 22 in the forward facing position. In FIG. 13 for example the upper part of the apparatus including the target arm 36 is pivoted forward about a pivot 124 to an angle 126 of less than 90° to allow a forward biasing force by way of gravity. Angles between 45°-95° may be employed with smaller angles providing more biasing force and a smaller relative target face to the shooter. As the angle 126 is decreased, the relative face of the paddles visible to the shooter clearly decreases. A preferred range of between 70° and 90° may be employed, and testing of the apparatus at about 20° have found a good balance between biasing force and relative target face.

Figure 2:
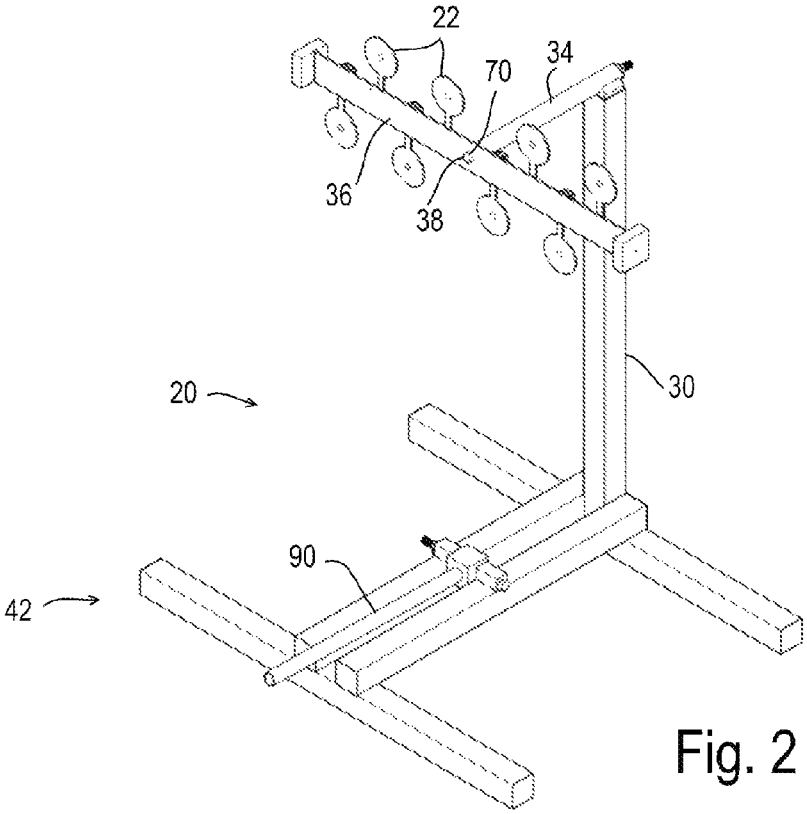
FIG. 2 is a front isometric view of the example shown in FIG. 1 in an arcade configuration.
Figure 3:
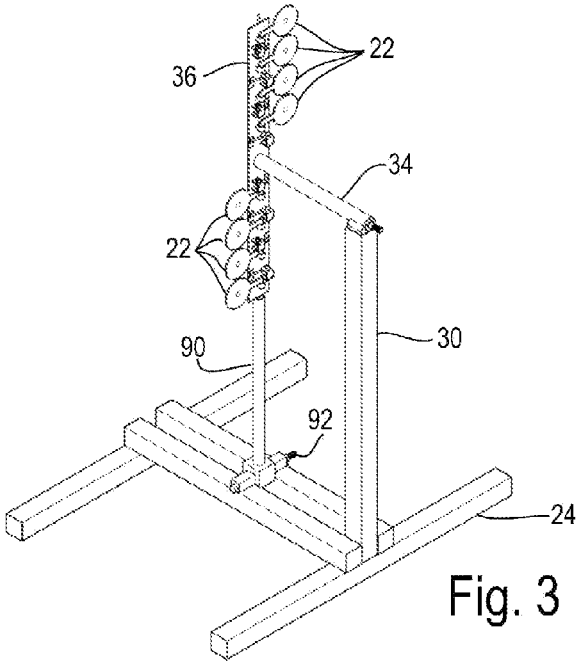
FIG. 3 is a rear isometric view of the example shown in FIG. 1.
Figure 6:
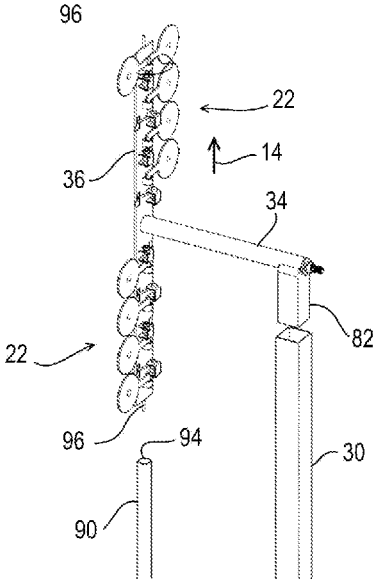
FIG. 6 is a partially disassembled view of the example shown in FIG. 3.
Figure 8:
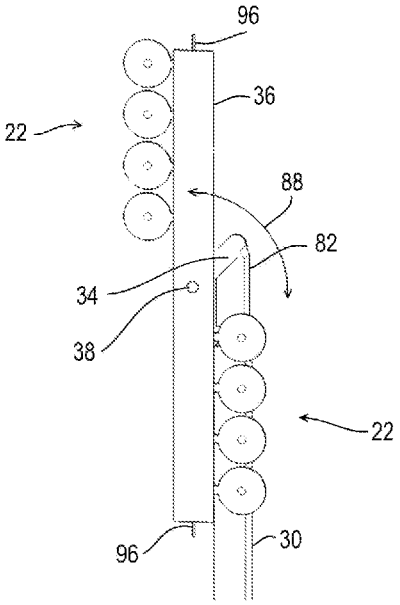
FIG. 8 is a detail enlarged view of the target portion of the example shown in FIG. 1 showing the vertical rotation arc from the dueling target configuration to the arcade configuration.

Different mechanisms may be utilized to maintain the target arm 36 in the dueling configuration 40 shown in FIG. 14 than the arcade configuration 42 of FIG. 2. One example of a device to hold the target arm 36 in position is shown which may be best understood by looking to FIG. 6-8. In this example, the transverse pivot support 34 is fixed to a pivot support leg 82 which extends vertically downward from the transverse pivot support 34. The pivot support leg 82 having an outer surface 84 slightly smaller than the surface defining a central cavity 86 of the support leg 30. In this way, the transverse pivot support 34 with target arm 36 attached thereto may be lifted vertically 14 upward out of the central cavity 86 and then the target arm 36 is rotated through a vertical rotation arc 88 as shown in FIG. 8. After rotation, the target arm 36 and attached transverse pivot support 34 may be lowered such that the pivot support leg 82 is set again within the central cavity 86. These steps may be reversed to return the apparatus to the dueling configuration 40.

To further maintain the target arm 36 in the dueling configuration 40 without undesired rotation, a pivot stop arm 90 may be utilized. As can be seen in FIG. 1, the pivot stop arm 90 may be attached by way of a pivot 92 to the base 24 to rotate from the position shown in FIG. 1 to the position shown in FIG. 2. In the position shown in FIG. 2 the pivot stop arm 90 does not hinder rotation of the target arm 36 and is not near any line of fire and therefore is not likely to be struck by a stray projectile. In the position shown in FIG. 1 which is the same as the position shown in FIG. 6, the pivot stop arm 90 may have an opening 94 in the vertical upper surface thereof into which is positioned a pin 96 projecting from the target arm 36. Thus, the pivot stop arm 90 with the pin 96 positioned therein aid in prohibiting rotation of the target arm 36 and target paddles 22 when the apparatus is in the dueling configuration 40.

Figure 9:
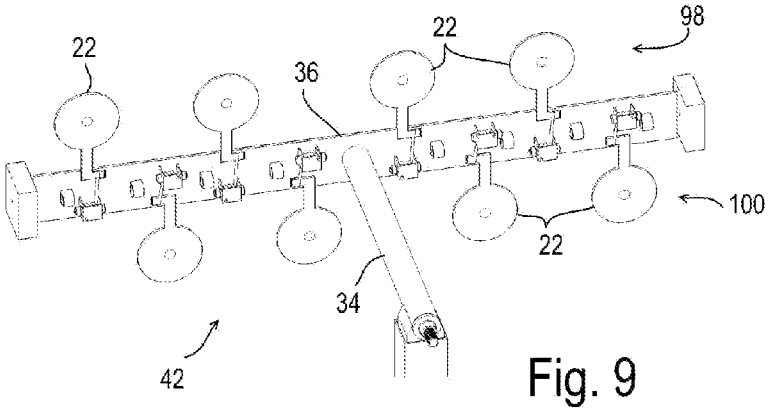
FIG. 9 is a rear enlarged view of a region of the apparatus shown in FIG. 2.

When the apparatus is in the arcade configuration 42, it is clear that the pivot brackets 60 used in dueling configuration 40 will only hold the target paddles 22 vertically below the target arm 36. Thus, in looking to FIG. 9-11, a different mounting system may be utilized for the same target paddles 22 shown and described previously. In this configuration, the target paddles 22 may be fitted to a plurality of upper positions 98 vertically above the target arm 36 as well as in a plurality of lower positions 100 vertically below the target arm 36. In each position, an arcade bracket 102 is provided a vertically opposing and adjacent paddle receiver 104. In the example shown, the paddle receiver 104 is a machined or otherwise provided indent 106. Other paddle receivers 104 could be utilized.

In the arcade configuration, the target arm 36 may be in any rotational position, and may be set to rotate manually or mechanically. Projectiles may then be fired at the target paddles in any position or during rotation.

The arcade bracket 102 in this example comprises a u-shaped extrusion 108 with a surface defining a void there through. This void provides a surface for a bolt 110 or equivalent fastener to pass there through. The bolt 110 having a washer and nut 112 attached to the opposite end. A coil spring 114 is held in place in part by way of wrapping (coiling) the coil spring around the bolt 110. A surface defining a counter rotation stop 116 may be provided to maintain the coil spring 114 from rotating. In the example shown a counter rotation stop 116 is provided by a surface defining a void through one surface of the extrusion 108. One end 118 of the coil spring 114 projects through this hole (rotation stop 116) to keep the coil spring 114 from rotating. The opposing end of the coil spring 114 comprises an extension arm 120 which presses against the protrusion portion 56 or extension arm 54 of the target paddle 22 to hold the protrusion 56 within the paddle receiver 114 when the target paddle 22 is properly installed. In use, when the forward surface of the target paddles 22 are impacted by a projectile, the target paddles will reposition rearward and then reposition forward once the projectile has passed. In most cases, this repositioning provides a visual and audial indication to the shooter that the target has been impacted. In addition, this movement reduces impact force and thus damage from the impact. In some applications where a significantly large or high velocity projectile impacts the target paddle 22, the target paddle may rotate past a center position and may not be repositioned automatically forward to a viewable position. Thus, manual reset may be necessary. Similarly it is conceivable that a high velocity, large mass, or off-angle projectile may impact the target paddle 22 whereupon the target paddle 22 will be removed from the target arm 36. The situation also requiring manual reset of the target paddle 22.

Figure 10:
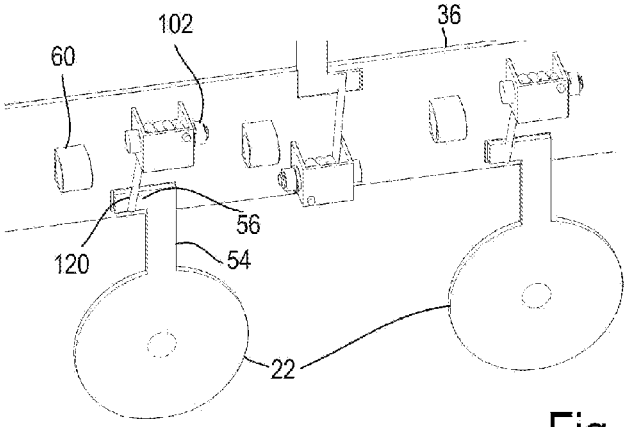
FIG. 10 is an enlarged view of a region of the apparatus shown in FIG. 9.
Figure 11:
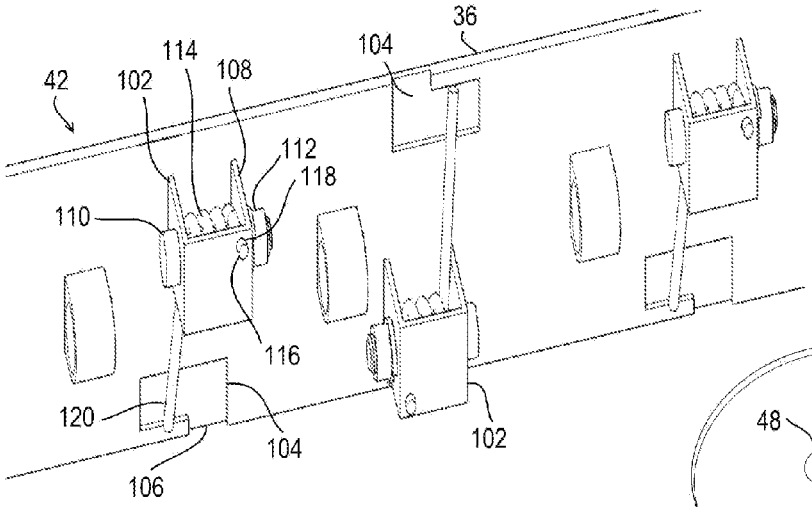
FIG. 11 is an enlarged view of a region of the apparatus shown in FIG. 9 with target paddles removed to show the underlying components.

In one example shown in FIG. 10, the apparatus is constructed so that upon impact from a projectile, the impacted paddle will fall off of the target arm 36. When this results in an uneven balancing of the target arm; (i.e. 4 paddles on the left side and 3 paddles on the right side) gravity will begin rotation of the target arm making the paddles more difficult to hit. The shooter may then attempt to even the number of paddles by shooting/removing a paddle on the heavy side to alter rotation velocity, or may alter rotation by attempting to shoot/remove a paddle on the light side (the side with fewer paddles thereon).

As the pins 96 are exposed in the arcade configuration, and the upper pin 96 is exposed in the dueling configuration, pin protectors 122 may be fitted about the pins 96. These may be simple components made of a polymer or natural material such as wood or metal.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. A reactive target comprising:

a ground-engaging base;

a support leg extending vertically from the base;

a projectile resistant target arm having a plurality of target paddles movably attached to a transverse rear side thereof;

the target arm rotatably fixed in a dueling configuration wherein a long axis of the target arm is oriented vertically;

wherein the target paddles pivot about a target paddle axis parallel to the long axis of the target arm;

the target arm rotatably fixed in an arcade configuration wherein the target arm is oriented horizontally;

the target arm having a transversely aligned target arm pivot generally substantially central to the long axis thereof to allow rotating of the target arm from the dueling configuration to the arcade configuration; and wherein the target arm pivot is coupled to an upper region of the support leg.

2. The reactive target as recited in claim 1 wherein the target arm in the dueling configuration is at an angle of less than 90° to the base with an upper end of the target arm positioned forward of the lower end so as to bias the target paddles to a forward facing position.

3. The reactive target as recited in claim 2 wherein the target arm in the dueling configuration is at an angle of between 90° and 70° to the base with an upper end of the target arm positioned forward of a lower end.

4. The reactive target as recited in claim 3 wherein the target arm in the dueling configuration is at an angle of between 85° and 75° to the base with an upper end forward of the lower end.

5. The reactive target as recited in claim 1 wherein the target arm is pivotably and adjustably coupled to the base to allow variation of the relative angle between the two components.

6. The reactive target as recited in claim 1 wherein:

the paddles are removably attached to the target arm between the arm of a coil spring attached to the target arm and an indent/detent of the target arm;

impact from a projectile removes the impacted target paddle from the target arm; and wherein removal of the impacted target paddle affects rotation of the target arm about the target arm pivot.

7. The reactive target as recited in claim 1 further comprising a pivot stop arm having a first end attached to the base and a second end coupled to the target arm so as to prevent rotation of the target arm in the dueling target configuration.

8. The reactive target as recited in claim 7 wherein the pivot stop arm is pivotably coupled to the base.

9. The reactive target as recited in claim 1 wherein all target paddles are substantially identical and interchangeable.

10. The reactive target as recited in claim 1 wherein all target paddles consist of a unitary flat panel and homogenous body.

* * * * *